US009474343B2

(12) United States Patent
Gracia

(10) Patent No.: US 9,474,343 B2
(45) Date of Patent: Oct. 25, 2016

(54) METHOD FOR MANUFACTURING BRACELET LINKS

(71) Applicant: The Swatch Group Management Services AG, Biel/Bienne (CH)

(72) Inventor: Jean-Claude Gracia, Mrigen (CH)

(73) Assignee: The Swatch Group Management Services AG, Biel/Bienne (CH)

( * ) Notice: Subject to any disclaimer, the term of this patent is extended or adjusted under 35 U.S.C. 154(b) by 194 days.

(21) Appl. No.: 14/315,511

(22) Filed: Jun. 26, 2014

(65) Prior Publication Data

US 2015/0013161 A1 Jan. 15, 2015

(30) Foreign Application Priority Data

Jul. 15, 2013 (EP) ..... 13176444

(51) Int. Cl.
*A44C 5/04* (2006.01)
*A44C 5/10* (2006.01)

(52) U.S. Cl.
CPC . *A44C 5/04* (2013.01); *A44C 5/10* (2013.01); *Y10T 29/49591* (2015.01)

(58) Field of Classification Search
CPC ..... Y10T 29/49591; Y10T 29/4959; Y10T 29/99588; Y10T 29/49593; Y10T 29/49595; Y10T 29/49789; Y10T 29/4979; Y10T 29/49792; Y10T 29/49794; A44C 27/00
See application file for complete search history.

(56) References Cited

U.S. PATENT DOCUMENTS 658,598 A * 9/1900 Stevens ..... H01R 43/205 29/20
1,081,451 A * 12/1913 Kerk ..... A61C 5/023 29/896.1
1,378,501 A * 5/1921 Wall ..... B21D 53/00 29/411
1,621,380 A * 3/1927 Ruder ..... B22D 13/066 164/114
1,678,239 A * 7/1928 Bayardi ..... B21D 53/44 29/896.41
2,450,448 A * 10/1948 Sawyer ..... B29C 67/00 132/107
2,795,070 A * 6/1957 Touche ..... G09F 13/16 29/412
2,829,488 A * 4/1958 Valli ..... A44C 5/08 29/33 Q
2,902,749 A * 9/1959 Manne ..... A44C 9/02 29/433

(Continued)

FOREIGN PATENT DOCUMENTS

EP 2 561 956 A1 10/1985
GB 2 374 516 10/2002

OTHER PUBLICATIONS

European Search Report issued Nov. 18, 2013 in EP Application 13176444, filed on Jul. 15, 2013 ( with English Translation).

*Primary Examiner* — Jason L Vaughan
(74) *Attorney, Agent, or Firm* — Oblon, McClelland, Maier & Neustadt, L.L.P

(57) ABSTRACT

1. Method of batch manufacturing bracelet links, characterized in that the method includes the steps of:

a) taking a profile bar made of a material in which the link blanks are delimited in relation to each other transversely by slots extending in a general direction of extrusion of the profile bar;
b) machining a first blank, if necessary, in the profile bar, while it is still in a single piece,
c) cutting the profile bar over a determined length defining the width of the link blanks so as to obtain a ring having the link blanks at the periphery thereof;
d) shaping the link blanks into the final form by a final rough machining operation;
e) thinning the surface of the ring forming the connection between the link blanks until the links are separated from each other.

19 Claims, 2 Drawing Sheets

(56) References Cited

U.S. PATENT DOCUMENTS 2,976,607 A * 3/1961 Obst ..... A44C 5/02 29/896.411
3,046,726 A * 7/1962 Gay ..... A44C 5/107 29/896.41
3,109,229 A * 11/1963 Cataldi ..... A44B 5/00 24/97
3,124,868 A * 3/1964 Zacaroli ..... H01L 21/00 228/123.1
4,432,122 A * 2/1984 Iijima ..... B23P 15/00 164/108
4,669,164 A * 6/1987 Phelps ..... B23P 13/04 29/412
6,272,726 B1 * 8/2001 Qvarth ..... B23C 5/006 279/138
6,389,790 B1 5/2002 Rosenwasser et al.
6,470,571 B1 * 10/2002 Namiki ..... A44C 11/005 29/417
6,739,052 B2 * 5/2004 Pratt ..... A44C 11/00 29/527.2
7,086,218 B1 * 8/2006 Pasach ..... A44C 5/10 29/896.412
7,946,034 B2 * 5/2011 Huck ..... B23D 31/003 29/415
2002/0056267 A1 5/2002 Rosenwasser et al.
2003/0121280 A1 7/2003 So et al.
2009/0241341 A1 * 10/2009 Solanilla ..... A44C 11/00 29/896.41

* cited by examiner

METHOD FOR MANUFACTURING BRACELET LINKS

This application claims priority from European Patent Application No. 13176444.1 filed 15 Jul. 2013, the entire disclosure of which is incorporated herein by reference.

FIELD OF THE INVENTION

The present invention concerns a method for manufacturing bracelet links. More specifically, the invention concerns a method for the batch manufacture of bracelet links from a profile bar.

BACKGROUND OF THE INVENTION

There are two techniques commonly used for manufacturing bracelet links, one consisting in machining the links entirely by bar turning, and the other in making blanks for the links by embossing or die stamping, and then finishing the blanks by machining. These two techniques are piece-by-piece techniques. Manufacture rates are relatively low and the cost price of the links is quite high.

SUMMARY OF THE INVENTION

It is an object of the present invention to overcome these drawbacks by providing a method for the batch manufacture of bracelet links.

The invention therefore relates to a method for the batch manufacture of a plurality of bracelet links, characterized in that the method includes the steps of:

a) taking a profile bar of a material in which the future links are delimited in relation to each other transversely through slots extending in the general direction of extrusion of the profile bar;
b) performing a first rough machining, if necessary, in the profile bar, while it is still in a single piece,
c) cutting the profile bar over a determined length defining the width of the links to obtain a ring having a blank for the future links at the periphery thereof;
d) shaping the links in their final form by final rough machining;
e) thinning the surface of the ring forming the connection between the links until the links are separated from each other.

As a result of these features, the present invention provides a method for the batch manufacture of bracelet links in which the links are machined while the profile bar is still in a single piece or, at the latest, when the profile bar has been cut into a plurality of rings each carrying a plurality of blanks for the links at the periphery thereof. The link blanks can thus be machined while they are still in batches, which reduces manufacturing costs and accelerates production rates. A last step may consist in polishing the links once they have been separated. Advantageously, the link blanks are delimited in relation to each other transversely by slots which are in a single piece when the profile bar is extruded, so that the link blanks are already separated into individual blanks when the profile is still in a single piece, which will then facilitate the subsequent link finishing operations.

BRIEF DESCRIPTION OF THE INVENTION

Other features and advantages of the present invention will appear more clearly from the following detailed description of an example implementation of the method of the invention, this example being given purely by way of non-limiting illustration with reference to the annexed drawing, in which.

DETAILED DESCRIPTION OF THE INVENTION

The present invention proceeds from the general inventive idea which consists in batch machining bracelet links in a profile bar. At least part of the machining operations can be carried out while the profile bar is still in a single piece or, at the latest, when the profile bar has been cut into a plurality of rings whose length determines a width of the links and wherein each ring groups together a plurality of link blanks. The machining operations can thus be carried out while the link blanks are still in batches, which accelerates manufacturing rates and reduces the cost price.

Figure 1:
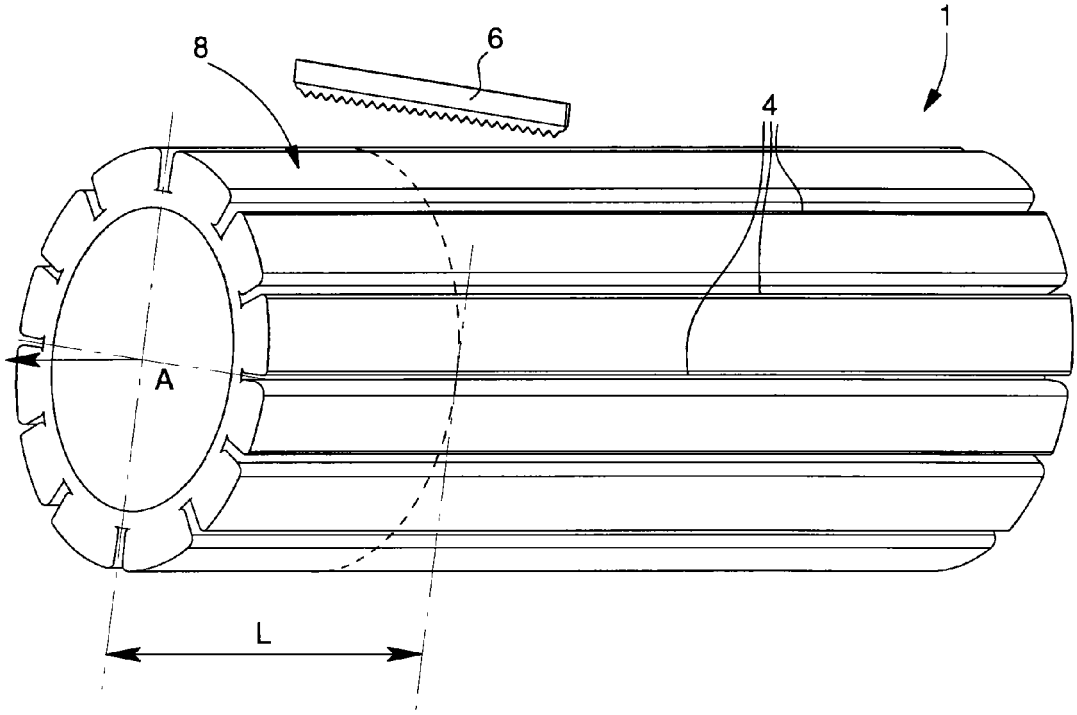
FIG. 1 is a perspective view of a profile bar according to the invention.

FIG. 1 is a perspective view of a profile bar for implementing the method of the invention. Designated as a whole by the general reference number 1, this profile bar may be made of any extrudable material such as aluminium, gold, silver, titanium, ceramic or a plastic material. Profile bar 1 is extruded in a general direction of extrusion A.

Figure 2:
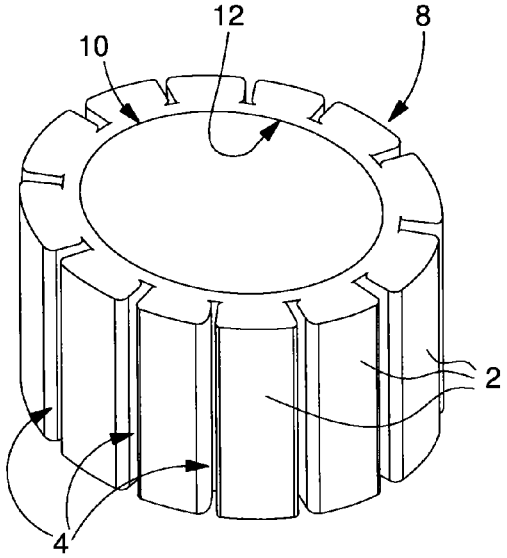
FIG. 2 is a perspective view of a ring cut into the profile bar of FIG. 1.
Figure 3:
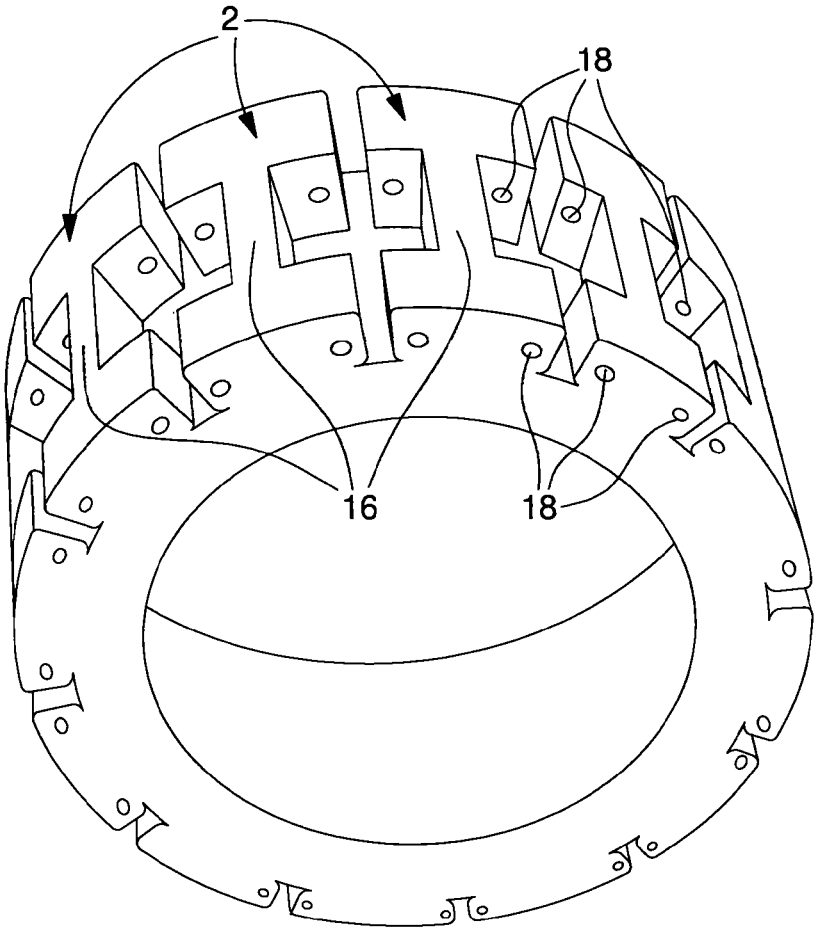
FIG. 3 is a perspective view of the ring of FIG. 2 on which the rough machining operations for the link have been performed.

As seen in FIG. 1, a plurality of link blanks 2 are delimited in relation to each other transversely by slots 4 extending in the general direction of extrusion A of profile bar 1. If necessary, the first machining operations of link blanks 2 may be performed in profile bar 1 while the latter is still in a single piece. At the latest, the rough grinding and finishing operations will be performed on link blanks 2 after profile bar 1 has been cut by means of a cutting tool 6 into a plurality of rings 8, one of which is shown in FIG. 2. The sectioning length L of profile bar 1 defines the width of link blanks 2.

Each ring 8 groups together on its periphery 10 a plurality of link blanks 2. According to a first embodiment of the invention which is not illustrated, link blanks 2 are distributed radially over the inner periphery of ring 8. According to a second embodiment illustrated in FIG. 2, link blanks 2 are distributed radially over the external periphery of ring 8. As will be seen below, the periphery 10 of ring 8 forms a surface 12 which connects link blanks 2 to each other until the links are separated from each other.

Figure 4:
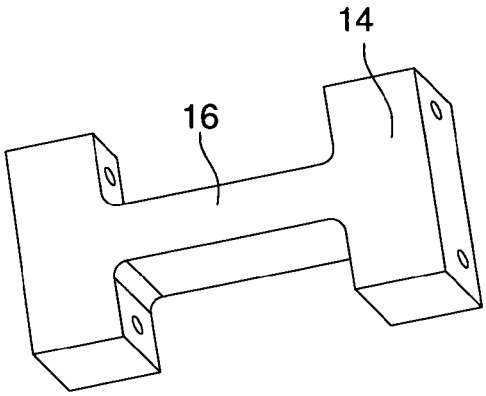
FIG. 4 is a perspective view of a link in the finished state.

Profile bar 1 may be solid. Preferably, it will be hollow. According to the invention, the link blanks 2 are shaped into their final form by a final rough machining operation. These machining steps are thus carried out while link blanks 2 are still in batches. The machining steps include machining the external shape of link blanks 2. For example, the finished links 14, an example of which is shown in FIG. 4, are H-shaped, with a cross bar 16 extending in the general direction of extrusion A. The final shaping step of link blanks 2 further includes the drilling of holes 18 intended to receive bars (not shown) for fixing the links to each other.

The final step of the manufacturing method of the invention consists in thinning the surface 12 of ring 8 until link blanks 2 are detached from each other to form a plurality of finished links 14. A final step of polishing finished links 14 may be envisaged.

It goes without saying that this invention is not limited to the embodiment that has just been described and that various simple modifications and variants can be envisaged by those skilled in the art without departing from the scope of the invention as defined by the annexed claims. It will be clear, in particular, that part of the machining operations may be performed while the profile bar is still in a single piece, or that it is also possible to cut the profile bar into a plurality of rings whose width corresponds to that of the rings.

What is claimed is:

1. A method of batch manufacturing bracelet links comprising:

extruding a profile bar along a general direction of extrusion, the profile bar made of a material in which link blanks are delimited in relation to each other transversely by slots extending in the general direction of extrusion;

cutting the profile bar over a determined length defining a width of the link blanks so as to obtain a ring including the link blanks at a periphery thereof;

shaping the link blanks into a final form by a final machining operation; and thinning a surface of the ring forming a connection between the link blanks until the links are separated from each other.

2. The manufacturing method according to claim 1, wherein the profile bar is hollow.

3. The method according to claim 2, wherein the slots are machined in an external periphery of the profile bar.

4. The method according to claim 3, wherein the shaping the link blanks includes machining an external shape of the link blanks.

5. The method according to claim 4, wherein the form of the links is H-shaped, the cross bar of the H extending in the general direction of extrusion.

6. The method according to claim 2, wherein the shaping the link blanks includes machining an external shape of the link blanks.

7. The method according to claim 6, wherein the form of the links is H-shaped, the cross bar of the H extending in the general direction of extrusion.

8. The method according to claim 1, wherein the slots are machined in an external periphery of the profile bar.

9. The method according to claim 8, wherein the shaping the link blanks includes machining an external shape of the link blanks.

10. The method according to claim 9, wherein the form of the links is H-shaped, the cross bar of the H extending in the general direction of extrusion.

11. The method according to claim 1, wherein the shaping the link blanks includes machining an external shape of the link blanks.

12. The method according to claim 11, wherein the form of the links is H-shaped, the cross bar of the H extending in the general direction of extrusion.

13. The method according to claim 1, wherein the shaping the link blanks further includes drilling holes intended to receive bars securing the links to each other.

14. The method according to claim 13, wherein the form of the links is H-shaped, the cross bar of the H extending in the general direction of extrusion.

15. The method according to claim 1, wherein the method further includes polishing the links that are separated.

16. The method according to claim 1, wherein the material of the profile bar is selected from among aluminium, silver, gold, titanium, a ceramic or plastic material.

17. The method according to claim 1, further comprising performing a first machining in the profile bar, while the profile bar is still in a single piece.

18. The method according to claim 1, wherein the ring includes an inner surface and an outer surface, and the thinning is performed on the inner surface of the ring.

19. A method of batch manufacturing bracelet links comprising:

extruding a profile bar along a general direction of extrusion, the profile bar made of a material in which link blanks are delimited in relation to each other transversely by slots extending in the general direction of extrusion;

cutting the profile bar over a determined length defining a width of the link blanks so as to obtain a ring including the link blanks at a periphery thereof;

shaping the link blanks into a final form by a final machining operation; and thinning an inner portion of the ring forming a connection between the link blanks from a radially inward position until the links are separated from each other.

* * * * *